United States Patent [19]

Molnar

[11] Patent Number: 4,511,449

[45] Date of Patent: Apr. 16, 1985

[54] CATHODE FOR A FUSED SALT REDUCTION CELL

[75] Inventor: Sandor Molnar, Neuhausen, Switzerland

[73] Assignee: Swiss Aluminium Ltd., Chippis, Switzerland

[21] Appl. No.: 549,921

[22] Filed: Nov. 9, 1983

[30] Foreign Application Priority Data

Nov. 15, 1982 [CH] Switzerland ..... 6635/82

[51] Int. Cl.[3] ..... C25C 3/08; C25C 7/02; C25B 11/03; C25B 11/12

[52] U.S. Cl. ..... 204/243 R; 204/67; 204/284; 204/290 R; 204/293; 204/294

[58] Field of Search ..... 204/67, 243 R-247, 204/290 R, 291, 294, 64, 284, 293; 264/65

[56] References Cited

U.S. PATENT DOCUMENTS

| | | | |
|---|---|---|---|
| 4,071,420 | 1/1978 | Foster, Jr. et al. | 204/64 R X |
| 4,097,567 | 6/1978 | Cebulak et al. | 264/65 |
| 4,308,115 | 12/1981 | Foster, Jr. et al. | 204/290 R X |
| 4,338,177 | 7/1982 | Withers et al. | 204/290 R X |
| 4,349,427 | 9/1982 | Goodnow et al. | 204/243 R |
| 4,396,481 | 8/1983 | Pawlek et al. | 204/243 R |
| 4,410,403 | 10/1983 | Jacobs et al. | 204/67 |
| 4,439,382 | 3/1984 | Joó et al. | 204/67 X |
| 4,443,313 | 4/1984 | Gesing et al. | 204/284 X |

*Primary Examiner*—Donald R. Valentine

*Attorney, Agent, or Firm*—Bachman and LaPointe

[57] ABSTRACT

In a fused salt electrolytic cell used in the production of aluminum, a cathode having work faces which are wet by aluminum, are resistant to attack by the molten electrolyte and are electrically conductive, is made up of a bed of loose shaped pieces or bodies located in the molten electrolyte. The pieces or bodies are made of a plurality of composite material elements bonded together which sink in molten aluminum, the composite material elements comprise a fine granular or chip-shaped substrate material selected from the group consisting of carbon, graphite, anthracite, aluminum nitride, silicon carbide and mixtures thereof having a thin layer coating of a material selected from the group consisting of titanium diboride, titanium carbide, titanium nitride, zirconium diboride, zirconium carbide, zirconium nitride and mixtures thereof completely and densely covering the surface of the substrate wherein the spaces between the coated substrate composite materials when bonded together to form the bodies are at least partly filled with the coating substance.

11 Claims, 2 Drawing Figures

CATHODE FOR A FUSED SALT REDUCTION CELL

BACKGROUND OF THE INVENTION

The present invention relates to a cathode for a fused salt reduction cell used in the production of aluminum wherein the cathode is chracterized by wettable work face surfaces which are resistant to the electrolyte and are electrically conductive.

In the production of aluminum by fused salt electrolytic reduction of aluminun oxide the aluminum oxide is dissolved in a fluoride melt made up for the most part of cryolite. The cathodically precipitated aluminum collects on the carbon floor of the cell below the fluoride melt, the surface of the molten aluminum or a solid body which can be wetted by molten aluminum forming the cathode. Dipping into the electrolyte from above are anodes which are secured to an overhead anode beam. In conventional fused salt reduction processes the anodes are made up of amorphous carbon. Oxygen is produced at the anodes as a result of the decomposition of the aluminum oxide; this oxygen combines with the carbon in the anodes to form $CO_2$ and CO.

The electrolytic process generally takes place at a temperature range of 940°-970° C. During the course of the process the electrolyte becomes deplete in aluminum oxide. At a concentration lower than approximately 1-2 wt.% aluminum oxide in the electrolyte an anode effect occurs where the voltage increases from for example 4-4.5 V to 30 V and higher.

It is known that a high current levels the combined effect of the vertical components of the magnetic field and the horizontal components of the current can lead to an undesired distortion on the surface of and some centimeters below the surface of the metal bath and to an undesired pronounced stirring of the metal bath. When the interpolar spacing is small, these distortions can be large enough to cause the aluminum to touch the anodes which results in short circuiting.

Furthermore, the stirring of the metal at the surface thereof can lead to increased chemical dissolution or fine dispersion of aluminum in the melt which, as is well known, results in a lower yield due to re-oxidation of the metal.

A lower current density is in theory advantageous, however, in reality would incur unacceptably high increases in the capital costs for the reduction pots and for the pot room.

Cathodes which can be wet by aluminum have been known for some time now. A characteristic of these cathodes is a thin layer of aluminum which can move only a little in the direction vertical to the work face. As a result, the classical surface distortion effects, that is, both stationary doming and moving waves, can to a large extent be eliminated. Apart from the very high material costs, however, the foregoing arrangement, with reduced interpolar spacing, suffers from the disadvantage that the circulation of electrolyte between anode and cathode is made more difficult as a result of which the cryolite melt becomes deplete in alumina due to the precipitation of aluminum and, therefore, the cell is prone to exhibit the above-noted anode effect. Two ways of improving the circulation of electrolyte were attempted in the prior art. In the first case the solid cathodes do not extend their whole surfaces, at a uniform spacing from the anodes over the whole work area thereof. Rather, individual parts of the cathode project upwards towards the anodes and/or slits are provided in the surface of the cathode. In the second case a pourable, particulate bulk material is introduced into the cell such that the bulk material is completely covered by the molten metal. In addition to the foregoing, U.S. Pat. Nos. 3,661,736 and 4,308,114 disclose the use of a solid composite cathode for an aluminum fused salt reduction pot. In these cases, refractory particles of a material which is wet by aluminum are embedded in a carbon matrix.

The first of the above mentioned patents proposes manufacturing the composite by mixing a fine carbon powder with granular titanium diboride and therefore treating the mix in a suitable thermal process. In the second patent, granular titanium diboride is mixed into tar or pitch. Such composite cathodes are only capable of being slightly wet by aluminum; the carbon matrix comes into contact with the electrolyte. The interpolar gap can be reduced at most to about 4 cm.

In light of the foregoing it is the principal to develop cathode for an aluminum molten salt reduction cell which is completely wet by aluminum, is not attacked by the electrolyte, can be manufactured economically and is easy to replace.

SUMMARY OF THE INVENTION

The foregoing object is achieved by way of the invention wherein the cathode is formed of a bed of loosely packed pieces or bodies in the electrolyte which sink in molten aluminum. The bodies are formed of a plurality of composite material elements which are a fine granular or chip-shaped substrate material selected from the group consisting of carbon, graphite, anthracite, aluminum nitride, silicon carbide and mixtures thereof having a thin layer coating of a material selected from the group consisting of titanium diboride, titanium carbide, titanium nitride, zirconium diboride, zirconium carbide, zirconiun nitride and mixtures thereof completely and densely covering the surface of the said substrate such that the spaces between the coated composite materials when bonded together to form the bodies are at least partly filled with the coating substance.

The carbon, graphite, aluminum nitride and/or anthracite particles or chips can be provided with a layer of silicon carbide onto which the actual protective layer of material which can be wet by aluminum is deposited.

The particles or chips forming the substrate usefully exhibit an average linear dimension in the range of 0.2-10 mm. The spectrum of particle or chip sizes is preferably small.

The substrate particles or chips are coated by means of known processes, for example, such as, sintering or melting. By using the foregoing coating processes the substrate particles or chips are usefully bonded together and the spaces between them are at least partly filled with the coating material. With reference to the composite material, the amount of coating material lies preferably between 2 and 40 wt.%, and preferably between 5 and 20 wt.%. Efforts are made to obtain a coating thickness of 20-200 μm, preferably 50-100 μm while maintaining the above-noted wt.% of coating material.

Although all shapes can be produced by these coating processes, it is preferred to produce large, shapeless pieces which can then be broken down into smaller pieces or bodies by striking with a hard object. The resultant smaller pieces usefully have an average linear dimension of 1–8 cm. Of course breaking down the large pieces can also lead to splitting and fracture of the substrate particles or chips. The relatively soft substrate parts are removed by sand blasting or dissolved during the electrolytic process. Any directly shaped parts are of the same order of magnitude or slightly larger than the pieces broken off.

The shaped pieces or bodies are poured into the pot of the reduction cell such that the uppermost layer projects up out of the molten aluminum and into the electrolyte. The additions of the bodies are localized so that the electrolyte, even if against greater resistance, can circulate. When the work face of the corresponding anode is horizontal, the bulk material added is also at the top surface facing the anode as horizontal as possible. When the anode is in place the interpolar gap is 2–4 cm. The same applies for inclined or vertical anode work faces.

The addition of the shaped pieces or bodies is preferably made such that larger pieces are at the bottom and smaller pieces are at the top.

For reasons of cost, a platform able to accommodate the bulk particulate material can be provided in the cathode pot below the anodes. Parts projecting from the platform into the molten electrolyte must be of a material which can be wet by aluminum and is resistant to the electrolyte and is, usefully, of material used for coating the substrate particles or chips. The floor of the platform is permeable to fluids so that the flowing away of the molten aluminum is not unduly hindered.

The horizontal projection of the platform is preferably at most equal to that of the corresponding anode/anodes.

The wettable cathodes of the present invention are such that, if the coating on an individual substrate particle or chip is dissolved or damaged, the change in geometry of the body is only slight as the next coating again acts as a barrier. For this reason it is preferred to employ substrate particles or chips which are of the order of 0.5–2 mm in size. Even smaller substrate particles or chips offer better protection against damage. On the other hand, in manufacturing the shaped pieces or chips more of the expensive coating material which can be wet by aluminum is used when smaller particles are used.

BRIEF DESCRIPTION OF THE DRAWINGS

The invention will be described in greater detail hereinbelow with the aid of the following schematic drawings wherein FIG. 1 Is a section through a body made out of coated chip-shaped substrates.

DETAILED DESCRIPTION

Figure 1:
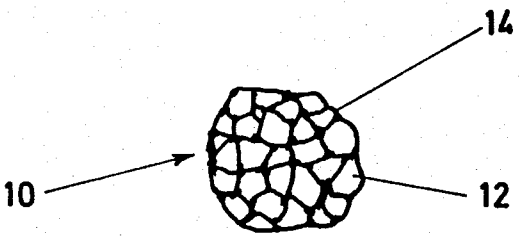

The body 10 shown in FIG. 1 comprises chips 12 which form the substrate and a thin coating 14 which bonds the substrate chips together. The substrate is formed of a material selected from the group consisting of carbon, graphite, anthracite, aluminum nitride, silicon carbide and mixtures thereof while the thin coating material is selected from the group consisting of titanium diboride, titanium carbide, titanium nitride, zirconium diboride, zirconium carbide, zirconium nitride and mixtures thereof. Before being coated with the coating material and sintered together, the individual chips 12 may be precoated with a thin layer of silicon carbide which is not illustrated here.

Figure 2:
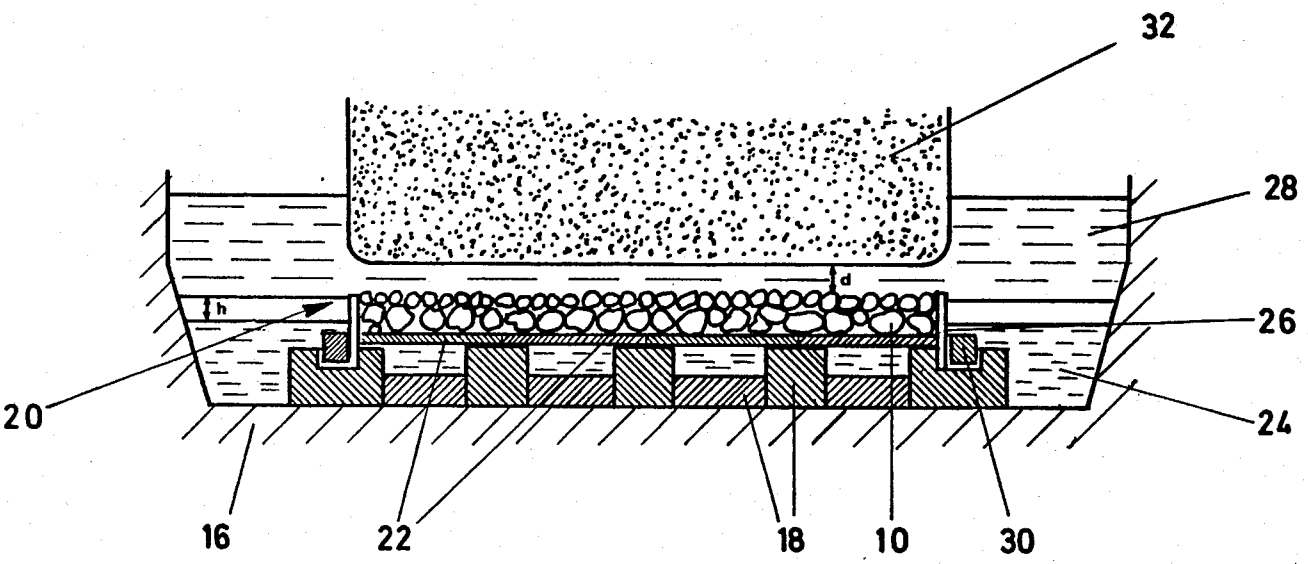
FIG. 2 Is a vertical front elevation, shown partly in cross section, of an electrolytic reduction cell containing bodies made out of coated chip-shaped substrates.

Only the carbon lining 16 of the fused salt reduction cell for producing aluminum is shown in FIG. 2. Provided on the horizontal floor of this carbon lining 16 are graphite tiles 18 which form the base for the platform 20 which support the shaped or chipped bulk material pieces or bodies 10 in the cell. The higher graphite tiles 18 support the silicon carbide plate 22 which features specifically arranged holes. The top of the pool of molten aluminum 24 is always slightly above this plate 22 even after removing aluminum from the cell. On removing aluminum from the cell the aluminum level falls by a distance h.

The platform is delimited at the sides by plates or rods 26 which project into the electrolyte. The plates or rods 26 can be wet by aluminum and are not attacked either by aluminum or the electrolyte 28. The plates or rods 26 are supported on the outside by silicon carbide sections 30.

The bulk particulate material poured loosely into the platform 20 is made up of a bed of bodies 10 comprised of substrate particles or chips sintered together by a material which is inert towards the electrolyte. Shown clearly in FIG. 2 is that the larger bodies 10 are arranged at the bottom of the bed while smaller bodies are at the top, that is, next to the anode/anodes 32. The upper bodies 10 form an approximately horizontal plane which is at a distance d, the interpolar gap, from the workface of the anode 32.

The anode 32 can be made of carbon or of an incombustible material, for example ceramic oxide. For simplification the steel shell, layer of insulation, cathode bars, crust of solidified electrolyte and other accessories have been omitted from the drawings. These, elements like the anode/anodes are constructed as known to the smelter expert.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a fused salt electrolytic cell used in the production of aluminum, said cell having a pot having a floor and sidewalls, at least one anode positioned within said pot and spaced from said floor and a cathode having working faces which can be wet by aluminum, are resistant to attack by the molten electrolyte and are electrically conductive, said cathode comprising a bed of loosely packed bodies which sink in molten aluminum, said bodies being formed of a plurality of composite material elements bonded together wherein each of said plurality of composite material elements comprises a substrate material selected from the group consisting of carbon, graphite, anthracite, aluminum nitride, silicon carbide and mixtures thereof having a thin layer coating of a material selected from the group consisting of titanium diboride, titanium carbide, titanium nitride, zirconium diboride, zirconium carbide, zirconium nitride and mixtures thereof completely and densely covering the surface of said substrate wherein said composite material elements are bonded together to form said bodies.

2. An electrolytic cell according to claim 1 wherein said substrate material is coated with silicon carbide prior to coating with said thin layer coating material.

3. An electrolytic cell according to claim 1 wherein the average linear dimension of said substrate is from about 0.2–10 mm.

4. An electrolytic cell according to claim 1 wherein the fraction of the wt.% of said thin layer coating material with reference to said composite, lies between 2 and 40 wt.%.

5. An electrolytic cell according to claim 1 wherein the fraction of the wt.% of said thin layer coating material with reference to said composite, lies between 5 and 20 wt.%.

6. An electrolytic cell according to claim 1 wherein the average linear dimension of said bodies is from about 1–8 cm.

7. An electrolytic cell according to claim 1 wherein said bodies are formed from crushed larger pieces.

8. An electrolytic cell according to claim 1 wherein smaller bodies are closer to said anode and larger bodies are further from the anode.

9. An electrolytic cell according to claim 1 wherein said bodies are situated on a platform having a base plate which is permeable by molten aluminum and side plates formed of material which is wet by aluminum and is resistant to attack by the electrolyte wherein said side plates project into the electrolyte.

10. An electrolytic cell according to claim 9 wherein said platform is parallel to the working face of said anode.

11. An electrolytic cell according to claim 1 wherein the top surface of said bodies is a distance of from about 2–4 cm below said anode.

* * * * *